United States Patent [19]

Mowles et al.

[11] 4,373,559

[45] Feb. 15, 1983

[54] APPARATUS FOR PRESSURIZING AN ADDITIVE TRANSFER DEVICE

[75] Inventors: Donald L. Mowles, Libertyville; James F. Middaugh, Gurnee; Sangvorn Rutnarak, Vernon Hills; Joseph N. Genese, Waukegan, all of Ill.

[73] Assignee: Abbott Laboratories, North Chicago, Ill.

[21] Appl. No.: 213,132

[22] Filed: Dec. 4, 1980

[51] Int. Cl.[3] ..... B65B 3/04

[52] U.S. Cl. ..... 141/18; 141/98; 141/309; 141/329; 128/272

[58] Field of Search ..... 141/1, 3–8, 141/18, 19, 20, 285, 59, 310, 98, 329, 330; 128/216, 272.2, 221, 218 M, 272; 222/80, 81, 83, 83.5

[56] References Cited

U.S. PATENT DOCUMENTS

| | | | |
|---|---|---|---|
| Re. 29,656 | 6/1978 | Chittenden et al. | 128/272.3 |
| 3,308,820 | 3/1967 | Hubbard | 128/216 |
| 3,354,916 | 11/1967 | Ruscitti | 141/20 |
| 3,385,607 | 5/1975 | Peltier | 141/329 |
| 4,058,121 | 11/1977 | Choksi et al. | 128/221 |
| 4,172,803 | 10/1979 | Ichikawa et al. | 252/60 |
| 4,271,875 | 6/1981 | Meshberg | 141/20 |

*Primary Examiner*—Houston S. Bell, Jr.

*Attorney, Agent, or Firm*—Neil E. Hamilton; Robert L. Niblack

[57] ABSTRACT

A pressurized additive transfer device for storing and transferring of a fluid material to a solution container such as a rigid container or an I.V. bag having an exposed pierceable closure or port. The transfer device is self-pressurized and includes a closure with channel portions to permit the introduction of a pressurizing media. The closure also has a central opening in alignment with a pierceable diaphragm. A piercing member having a double pointed end is disposed in the central opening which affords a movement of the piercing member toward the pierceable diaphragm to pierce it. Frictional engagement elements are provided between the piercing member and the central opening to hold the piercing member when it punctures the diaphragm as well as the solution container closure or port. In one embodiment, a vent slot is provided in the piercing member to serve as a vent for the solution container.

14 Claims, 6 Drawing Figures

APPARATUS FOR PRESSURIZING AN ADDITIVE TRANSFER DEVICE

BACKGROUND OF THE INVENTION

This invention relates to a device for transferring a fluid material to a solution container having an exposed closure. More particularly, this invention relates to a pressurized additive device wherein the closure for the additive container has channel portions to permit the introduction of a pressurizing media and accommodates a double-pointed piercing element for piercing through the closure of the solution container as well as the additive container to afford a self-propelling of the fluid material from the additive container to the solution container.

A pressurized device for delivering a liquid medicament from a syringe-type vial is described in U.S. Pat. No. 3,308,820. Vented piercing pin structures for use in delivering a product from a vial or syringe into another container are illustrated in U.S. Pat. Nos. 4,172,803 and 4,058,121. In U.S. Pat. No. Re. 29,656, a slidable piercing member for a nonpressurized additive transfer unit is described.

Nowhere in the prior art is there available a pressurized additive transfer unit for storing and automatically transferring a fluid material to a solution container wherein the unit has a closure specifically adapted to permit the introduction of the pressurizing media. Neither does the prior art provide such a pressurized additive transfer unit wherein a double-pointed piercing member provides fluid communication between the additive transfer unit and the solution container while, at the same time, affording a venting of the solution container.

It is an advantage of the present invention to afford a pressurized additive transfer device wherein the closure facilitates introduction of the pressurizing media. Other advantages are a pressurized additive transfer unit wherein a double-pointed piercing member and the closure for the transfer device have frictional engagement and stop means for retaining the piercing member in the closure of the transfer unit in an operative position as well as limiting movement thereof; a vented double-pointed piercing member providing fluid communication between the additive transfer unit and the solution container as well as venting of the solution container; a pressurized additive transfer unit which is adaptable to filling either a rigid or flexible container.

SUMMARY OF THE INVENTION

The foregoing advantages are accomplished and the shortcomings of the prior art are overcome by the present pressurized additive transfer unit wherein the closure includes both a means for filling the unit with a pressuring media as well as a means for movably receiving a double-pointed piercing member and frictionally retaining the piercing member in the closure after a piercing thereof. In one embodiment, a venting means is operatively associated with the double-pointed piercing member to afford a venting of the solution container as fluid material is transferred under pressure from the transfer unit to the solution container. A stop member is provided on the piercing member to limit movement of the piercing member into the closure of the additive vial as well as the solution container. In the instance where the venting means is a groove and employed with the stop member, the stop member affords complete introduction of the vent groove into the stopper of the solution container and affords a venting through the stop member.

BRIEF DESCRIPTION OF DRAWING

A better understanding of the pressurized additive transfer unit of this invention will be afforded by reference to the drawing wherein.

DESCRIPTION OF THE EMBODIMENTS

Figure 1:
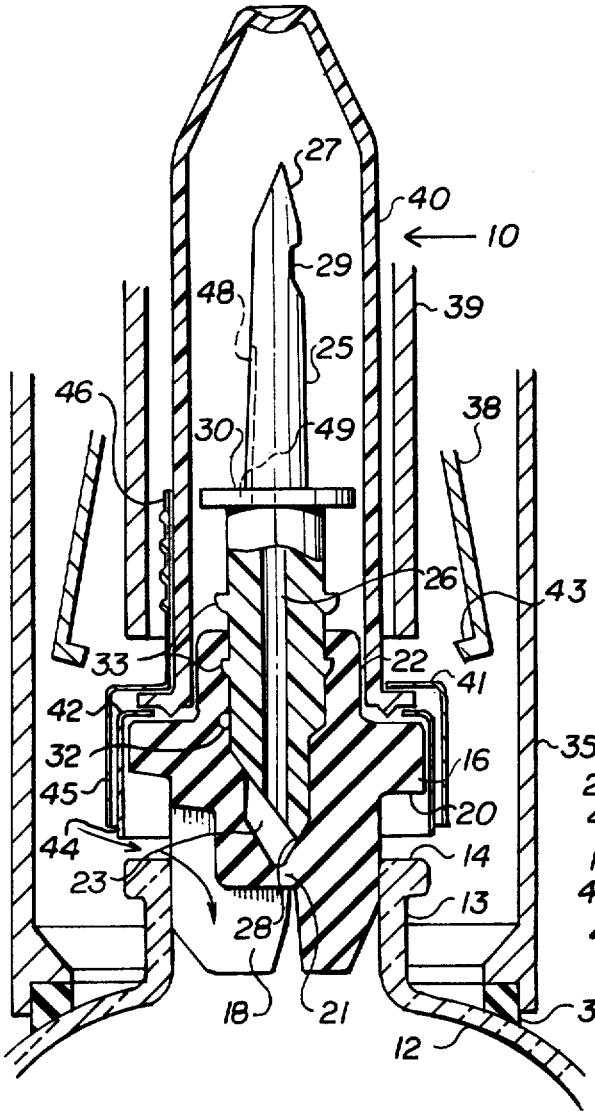
FIG. 1 is a view in side elevation with portions shown in vertical section of the additive transfer unit of this invention being pressurized with gaseous nitrogen and illustrating a portion of the container.
Figure 2:
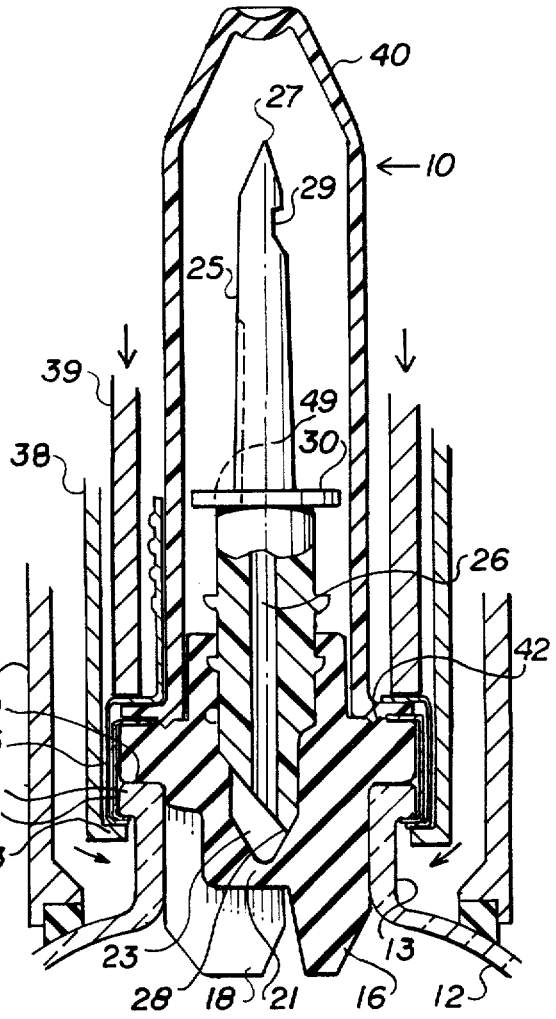
FIG. 2 is a view similar to FIG. 1 except showing the pressurized unit after filling with a pressurizing media and securing of the closure thereon.
Figure 3:
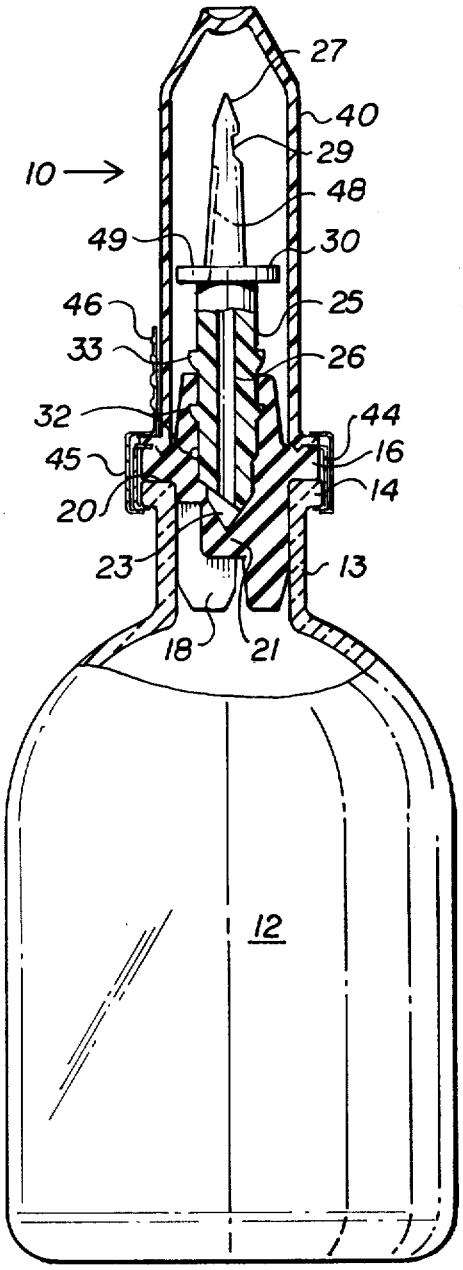
FIG. 3 is a view similar to FIG. 2 showing the pressurized additive unit in a storage condition and prior to use.

Proceeding to a detailed description of one embodiment of the invention, the pressurized additive transfer unit generally 10 is shown in FIGS. 1, 2 and 3. It is adapted to being utilized in conjunction with a standard rigid container or vial 12 having a rigid neck 13 and a finish 14. The additive transfer unit 10 is illustrated in FIG. 1 in a filling condition wherein the closure 16 having a channel portion 18 is raised above finish 14 so as to provide a fluid passageway to the outside of the container. A shoulder 20 is provided in closure 16 for ultimately resting on finish 14. A pierceable diaphragm section 21 is disposed in closure 16 which also has a central opening 23 to accommodate a slidable piercing member 25 having a longitudinal passageway 26 communicating with both ends thereof. At each end of the piercing member 25 are oppositely positioned piercing points 27 and 28. A laterally positioned orifice 29 is disposed adjacent piercing point 27 to provide fluid communication with passageway 26. A stop member 30 in the form of an annular shoulder extends from the piercing member as do projections 33. Projections 33 are accommodated in closure 16 by means of undecuts 32. As illustrated in FIG. 1, a filling collar 35 surrounds the preassembled additive unit for purposes of introducing a pressurizing media such as gaseous nitrogen into the container, which will be previously filled with a sterilizable fluid material such as dextrose solution, water for injection, or sodium chloride for injection. A fluid-tight connection with container 12 is afforded by means of seal 36.

Referring to FIG. 2, the fixing of closure 16 of additive unit 10 on container 12 is illustrated wherein crimping tool 38 with flange 43 will surround an outer ferrule 45 to crimp it underneath finish 14. The crimping is facilitated also through a push-on sleeve 39 which will force the outer ferrule downwardly against flange 41 of protective hood 40. At the same time, an inner ferrule 44, which holds closure 16 onto container 12, will also be crimped thereon. The assembled unit will then appear as shown in FIGS. 2 and 3. In order to assure proper sealing, an additional sealing flange 42 is disposed beneath hood flange 41 for frictionally engaging closure 16. It will be noted in embodiment 10 that an open groove or vent 48 extends longitudinally along the outside of piercing member 25. The groove extends into stop member 30 for communication with groove 49.

Figure 4:
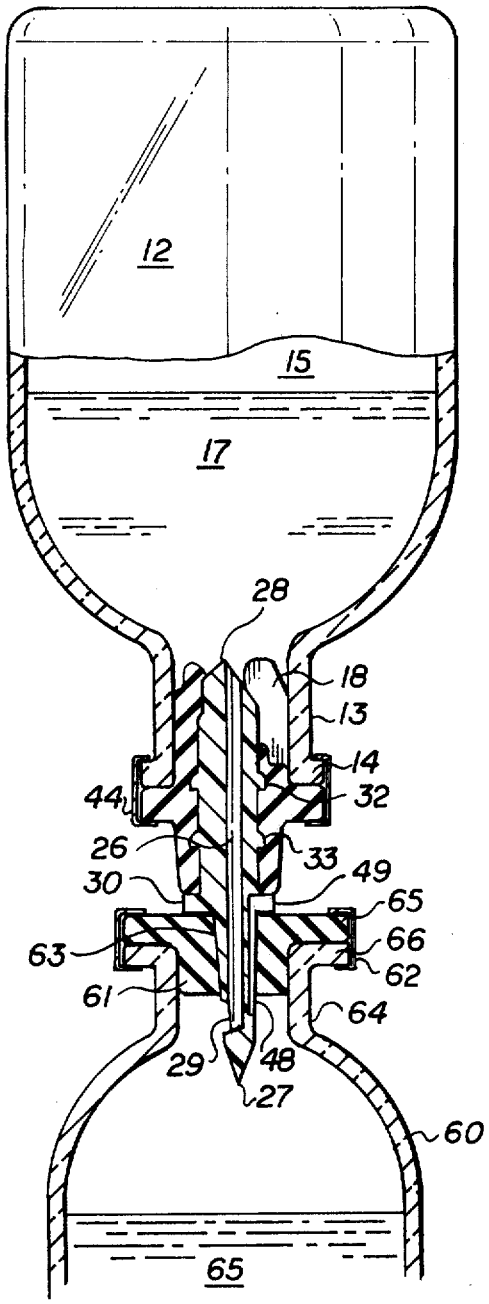
FIG. 4 is a view in partial vertical section showing the inverted pressurized additive vial delivering a fluid material into a rigid solution container.
Figure 5:
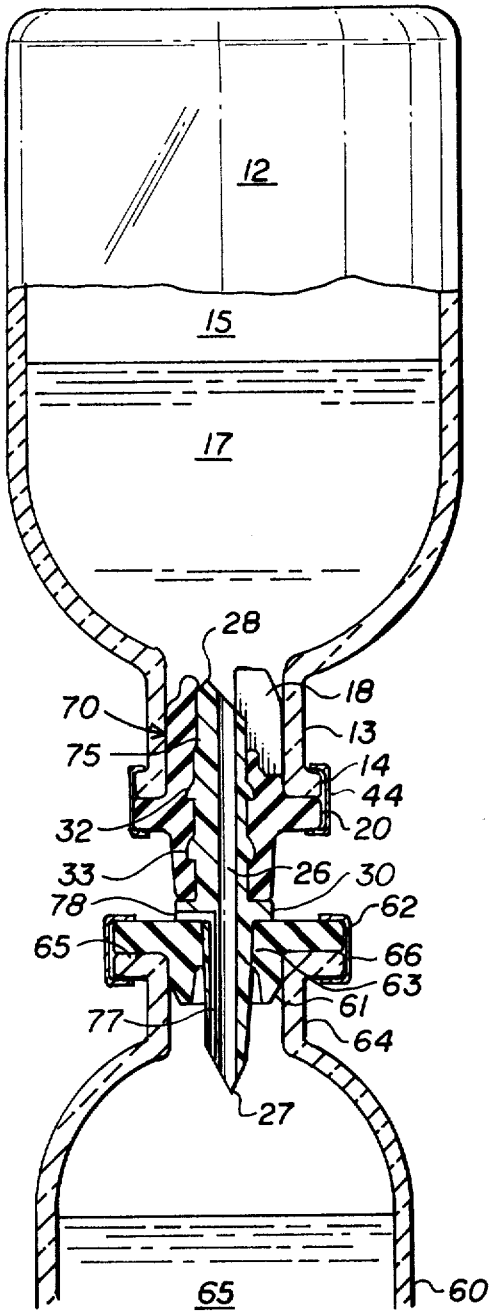
FIG. 5 is a view similar to FIG. 4 except showing a different venting arrangement for the piercing member.

An additional embodiment of the pressurized transfer unit 70 is illustrated in FIG. 5. The difference between this embodiment and that illustrated in FIGS. 1–4 is that in place of a vent slot or groove on the external surface of the piercing member, the piercing member 75 utilized therein has an internal vent channel 77 which extends from the pointed tip portion 27 to stop 30 where a lateral vent channel 78 is provided. All other components of this embodiment are the same as previously described and thus are referred to by the same numbers. A more detailed description of these embodiments will be effected in the operation.

Figure 6:
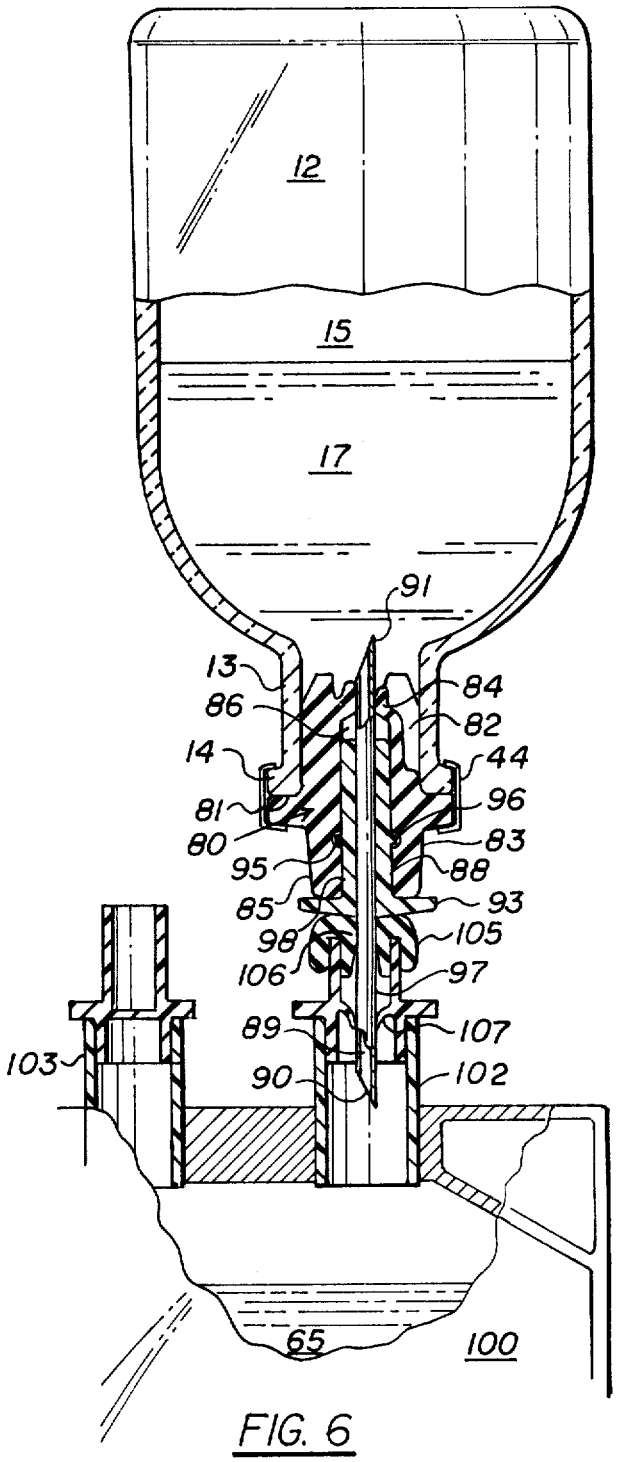
FIG. 6 is a view similar to FIGS. 4 and 5 except showing the pressurized additive unit for use with a flexible container and the piercing member being nonvented.

A further embodiment of a pressurized additive unit 80 is illustrated in FIG. 6. This particular embodiment is specifically designed to be utilized in conjunction with a plastic container such as an I.V. bag 100 rather than a rigid container illustrated in FIGS. 4 and 5. This unit 80, therefore, differs from units 10 and 70 in that it does not have or require a vent structure as illustrated in the FIGS. 4 and 5 embodiments. The closure 83 for this particular embodiment is somewhat different than the previous one in that it has only a single undercut 95 for accommodating a single projection 96 on the piercing member 88. As in the previous embodiments, closure 83 has a shoulder 81 for resting on finish 14 as well as a channel portion 82 for filling with a pressurizing media. A pierceable diaphragm portion 84 is likewise provided for piercing by point 91 and an opposing piercing point 90 is also provided, as well as a channel 89 communicating with opposing ends of the piercing member. The piercing member is positioned in the central opening 86 of the closure as well as the cylindrical portion 85. A stop member 93 extends from the piercing member 88 and serves as a means of limiting movement of the piercing member through the closure 83.

OPERATION

A better understanding of the advantages of the pressurized additive devices 10, 70 and 80 will be had by a description of their operation. The operation of unit 10 will be accomplished first. As described earlier, container 10 will have been charged with a suitable pressurizing media, such as gaseous nitrogen 15, and closure 16 with piercing member 25 and hood 40 secured to the container. The preferred gaseous pressure will be 17–24 psig. In a stored condition, additive unit 10 will appear as illustrated in FIG. 3. Container 12 will preferably contain a fluid material such as previously described and indicated by the numeral 17. The transfer of the contents of container 12 will be intended for placement in a rigid container 60 which will have the usual closure 61 secured on the container through a ferrule 62 engaging the finish 65 of neck 64 to hold shoulder 66 against the neck finish. A pierceable diaphragm portion 63 will also be provided.

When it is desired to transfer the contents of additive container 12 into solution container 60, hood 40 will be removed by a pulling action on pull tab 46 which will remove outer ferrule 45 as well as hood 40. Solution container will have previously placed therein preferably a powdered material such as an antibiotic. Container 12 will be inverted and point 27 of piercing member 25 will engage closure 61 so as to pierce through the diaphragm portion 63. This engagement will simultaneously force the opposing piercing point 28 through the pierceable diaphragm section 21 of closure 16 with such movement continuing until stop 30 rests against closure 16 with projections 33 occupying spaced apart undercuts 32 in the closure. Fluid communication is now provided between containers 12 and 60. As the contents of container 12 is under pressure, it will automatically flow through passageway 26 and into container 60. A resulting pressure will also tend to be built up in container 60. This will be alleviated by means of vent slots 48 and 49 which will provide a fluid passage between the inside of container 60 and the atmosphere as best seen in FIG. 4. This will result in the desired mixed solution 65 in container 60.

The operation of additive unit 70 is the same as for unit 10 except that instead of an open vent groove 48 and 49, a closed vent channel 77 and 78 provide the venting of any pressure which tends to accumulate in container 60. The venting will take place laterally between stop 30 and solution container closure 61.

Embodiment 80 of the pressurized additive unit is illustrated in conjunction with the usual plastic I.V. solution container 100 which includes an additive port 102 and an administration port 103. The additive port 102 has the usual reseal device 105 with a pierceable diaphragm portion 106. An inner pierceable diaphragm section 107 is also disposed in this port. The operation of this unit 80 is substantially the same as for the previous ones except that as no venting is required for the flexible container 100, no venting means need be utilized in conjunction with piercing member 88 and the additive unit is also in an inverted or superior position. Stop 93 will, as in the previous embodiments, afford predetermined movement of opposing points 90 and 91 through the closures of the respective containers. As piercing member 88 has only a single projection 96, there is only a single undercut 95 in the closure for placement therein, as the projection 96 moves from outside closure 83 to the inside thereof. It will be appreciated that as piercing point 90 need only pierce through relatively thin diaphragm portions as compared to those required to be pierced by point 27 in piercing members 25 and 75, the frictional engagement means for retaining the respective piercing pin in the additive stoppers need not be as extensive so as to permit withdrawal therefrom. However, if desired, two pairs of projections and undercuts could be employed as illustrated in embodiments 10 and 70.

The preferred materials for fabricating piercing members 25 and 75 is a polycarbonate plastic material. However, other materials such as acetals or acrylonitrile-butadiene-styrene could be substituted and still accomplish the desired pressurized transfer as described herein. Piercing member 88 is actually formed in two parts, with a needle component forming the central portion and providing the sharpened ends 90 and 91 and the metallic needle being surrounded by a hub section 98. In this instance, the hub section can be formed of polypropylene, thermoplastic polyester or the same plastic materials as previously described for piercing members 25 and 75. All of the stopper-closures described in the containers are formed from a suitable rubber material such as butyl rubber. Other similar materials such as styrene, nitrile, neoprene, or silicone material could be substituted. The preferred pressurizing media is nitrogen gas. However, other pressuring media such as filtered air, liquid nitrogen or other inert gases or mixtures thereof could be employed with suitable filling equipment. The additive containers 12 have been illustrated for use in containing dextrose solution, water and sodium chloride for injection under pressure. If desired, any suitable diluent and flowable material such as potassium chloride for injection, amino acid solutions, alone or in conjunction with carbohydrates and/or electrolytes could likewise be utilized for transfer to a solution container which can contain a liquid or powder material.

It will be appreciated that as container 12 is under pressure and preferably made of glass, some type of protection should be affforded to prevent the glass from shattering should the container be dropped. This can be accomplished by providing a plastic shroud around the outside of the container.

It will thus be seen that through the present invention there is now provided a pressurized additive vial which is easily pressurized, assembled and employed. The pressurized unit is adaptable for being used for both a rigid and semi-rigid container, and employes a sequencing type slidable piercing pin and stopper arrangement to assure that fluid contact is made with the solution container before fluid communication with the additive container. This obviates undue loss of material.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

What is claimed is:

1. An apparatus for pressurizing an additive transfer unit for storing and transferring a fluid material to a solution container having an exposed closure, said transfer unit including:

a self-pressurized additive container for storing the medicament to be transferred, said additive container having a rigid neck portion defining a finish, the opening in said additive container being sealed by a closure affixed thereto;

said closure having a shoulder for resting against said finish of the rigid container neck, said closure including a puncturable stopper with a pierceable diaphragm portion positioned in sealing engagement with the opening in the additive container;

a central portion defined by said closure in axial alignment with said pierceable diaphragm;

said closure further including channel portion in said diaphragm portion to permit the introduction of a pressurizing media when said closure partially engages said container neck and prior to said shoulder engaging said neck finish;

means to affix said closure to said additive container;

a piercing member having a stop member and a passageway therethrough for the flow of said medicament and a point on both ends thereof;

means operatively associated with said closure central portion and said piercing member to provide movement from the first position for entry through the closure of the solution container with said stop constructed and arranged to contact said exposed closure of said solution container to a second position for puncturing of the stopper in the additive container; and frictional engagement means operatively associated with said piercing member and said central portion to frictionally hold said piercing member in said central portion when said piercing member punctures said diaphragm;

said apparatus comprising:

filling collar means engagable in a fluid tight manner on said additive container and surrounding said closure, said filling collar means being operatively connected to a source of pressurizing fluid media; and crimping means concentrically and internally positioned with respect to said filling collar means to engage said closure affixing means to affix said closure to said additive container;

a pathway being formed by said closure channel portion in said diaphragm portion to permit the pressurizing fluid media to enter the additive container from the filling collar means.

2. The apparatus for pressurizing an additive transfer unit as defined in claim 1 wherein said pressurizing media is nitrogen gas.

3. The apparatus for pressurizing an additive transfer unit as defined in claim 2 wherein said pressurizing media is introduced as gaseous nitrogen and through said channel portions of said closure.

4. The apparatus for pressurizing an additive transfer unit as defined in claim 1 further including a vent channel operatively associated with said piercing member so that when said piercing member is positioned through said closure of said solution container, a passageway between the inside of said solution container and outside atmosphere is created.

5. The apparatus for pressurizing an additive transfer unit as defined in claim 4 wherein said vent channel is defined by an open groove.

6. The apparatus for pressurizing an additive transfer unit as defined in claim 5 wherein said stop includes a groove and both said grooves are continuous.

7. The apparatus for pressurizing an additive transfer unit as defined in claim 1 wherein said shoulder for resting against said finish of the container is defined by a flange and said means to affix said flange to said finish is a ferrule.

8. The apparatus for pressurizing an additive transfer unit as defined in claim 7 further including a removable hood member secured to said ferrule and covering that portion of said piercing member extending from said central portion.

9. An apparatus for pressurizing an additive transfer unit for storing and transferring a fluid material to a solution container having an exposed closure, said transfer unit including:

a self-pressurized additive container for storing the fluid material to be transferred, said additive container having a rigid neck portion defining a finish, the opening in said container being sealed by a closure affixed thereto;

said closure having a shoulder for resting against said finish of the rigid container neck, said closure including a puncturable stopper positioned in sealing engagement with the opening in the additive container and in a substantially stationary manner, said stopper including channel portion to permit the introduction of a pressurizing media when said closure partially engages said container neck;

means for affixing the stopper to the additive container;

said stopper including a central opening extending along the longitudinal axis thereof with an end of the stopper projecting into the container being sealed by said puncturable diaphragm;

a piercing member having a passageway therethrough for the flow of said medicament and a point on both ends thereof and slidably disposed within the central opening in said stopper, one end of the piercing member extending from said opening;

said piercing member having a stop and being movable from a first position for entry through the closure of the solution container to a second position for puncturing of the diaphragm of the stopper in the additive container and permit the said fluid material within the additive container to transfer into the solution container;

said stop of the piercing member including an annular shoulder extending from the body thereof at a point in the portion of the piercing member which extends from the central opening in the stopper, said shoulder preventing excessive movement of the piercing member in the central opening in the stopper when the piercing member is inserted in the closure of said solution container;

said piercing member including an elongated body with said point on either end thereof and a projection extending from the body intermediate the ends thereof;

the central opening within the stopper including an undercut to receive the projection on the piercing member when the piercing member is moved from the first position to the second position within the central opening in the stopper for puncturing of the diaphragm of the stopper whereby the projection on the piercing member will engage the undercut in the opening in the stopper to thereby retain the piercing member within the opening in the stopper when the transfer unit is withdrawn from the solution container;

said apparatus comprising:

filling collar means engagable in a fluid tight manner on said additive container and surrounding said closure, said filling collar means being operatively connected to a source of pressurizing fluid media; and crimping means concentrically and internally positioned with respect to said filling collar means to engage said closure affixing means to affix said closure to said additive container;

a pathway being formed by said closure channel portion in said diaphragm portion to permit the pressurizing fluid media to enter the additive container from the filling collar means.

10. The apparatus for pressurizing an additive transfer unit as defined in claim 9 wherein said stop is integrally formed on said piercing member.

11. The apparatus for pressurizing an additive transfer unit as defined in claim 9 wherein said pressurizing media is nitrogen gas.

12. The apparatus for pressurizing an additive transfer unit as defined in claim 9 further including a vent channel operatively associated with said piercing member so that when said piercing member is positioned through said closure of said solution container, a passageway between the inside of said solution container and outside atmosphere is created.

13. The apparatus for pressurizing an additive transfer unit as defined in claim 12 wherein said vent channel is defined by an open groove.

14. The apparatus for pressurizing an additive transfer unit as defined in claim 12 wherein said vent channel is defined by a closed passageway having an orifice open to the atmosphere.

* * * * *